US010926551B2

(12) United States Patent
Kuroda et al.

(10) Patent No.: US 10,926,551 B2
(45) Date of Patent: Feb. 23, 2021

(54) HEAT TRANSFER SYSTEM, WINDING DEVICE, HEAT TRANSFER METHOD, AND WINDING METHOD

(71) Applicant: Dai Nippon Printing Co., Ltd., Tokyo (JP)

(72) Inventors: Koichiro Kuroda, Tokyo (JP); Yoshiyuki Nakamura, Tokyo (JP); Daisuke Fukui, Tokyo (JP); Miki Kato, Tokyo (JP); Tomoko Suzuki, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 16/330,204

(22) PCT Filed: Sep. 27, 2017

(86) PCT No.: PCT/JP2017/035020
§ 371 (c)(1),
(2) Date: Mar. 4, 2019

(87) PCT Pub. No.: WO2018/062304
PCT Pub. Date: Apr. 5, 2018

(65) Prior Publication Data

US 2019/0202212 A1 Jul. 4, 2019

(30) Foreign Application Priority Data

Sep. 28, 2016 (JP) ..... JP2016-190081

(51) Int. Cl.

| | |
|---|---|
| ***B41M 5/40*** | (2006.01) |
| ***B41J 2/325*** | (2006.01) |
| ***B41J 33/14*** | (2006.01) |
| ***B41M 5/44*** | (2006.01) |
| ***B41J 35/38*** | (2006.01) |
| ***B41J 17/38*** | (2006.01) |
| ***B41M 5/42*** | (2006.01) |

(52) U.S. Cl.
CPC ..... *B41J 2/325* (2013.01); *B41J 17/38* (2013.01); *B41J 33/14* (2013.01); *B41J 35/38* (2013.01);
(Continued)

(58) Field of Classification Search
CPC ... B41J 2/325; B41J 17/38; B41J 35/38; B41J 33/14; B41M 5/44; B41M 5/40; B41M 5/426
See application file for complete search history.

(56) References Cited

U.S. PATENT DOCUMENTS

| | | | |
|---|---|---|---|
| 4,788,559 | A | 11/1988 | Ende |
| 2008/0274310 | A1 | 11/2008 | Fukui et al. |

(Continued)

FOREIGN PATENT DOCUMENTS

| | | | |
|---|---|---|---|
| GB | 2 115 747 | A | 9/1983 |
| JP | S58-128890 | A1 | 8/1983 |

(Continued)

OTHER PUBLICATIONS

English translation of International Preliminary Report on Patentability (Chapter I) (Application No. PCT/JP2017/035020) dated Apr. 11, 2019, 13 pages.

(Continued)

*Primary Examiner* — Yaovi M Ameh
(74) *Attorney, Agent, or Firm* — Burr & Brown, PLLC

(57) ABSTRACT

A heat transfer system is provided with a first heating element that transfers ink in an ink layer to a transfer-receiving body in a first pattern, a winding part that winds an ink ribbon having ink transferred therein on the downstream side of the first heating element in such a manner that a back surface layer is positioned outside the ink layer, a second heating element that transfers ink in the ink layer to the back surface layer inside the ink layer in a second pattern
(Continued)

near the winding part, and a controller that controls the heating elements, and the controller controls the first heating element to transfer ink corresponding to the first pattern by transferring a portion of the ink layer, and controls the second heating element to transfer ink corresponding to the second pattern by transferring the ink layer as a whole.

11 Claims, 11 Drawing Sheets

(52) U.S. Cl.
CPC ..... *B41M 5/40* (2013.01); *B41M 5/426* (2013.01); *B41M 5/44* (2013.01)

(56) References Cited

U.S. PATENT DOCUMENTS

| | | | | |
|---|---|---|---|---|
| 2015/0001115 | A1* | 1/2015 | Ito | B41M 5/38214 206/393 |
| 2016/0221376 | A1* | 8/2016 | Yabe | B32B 27/06 |

FOREIGN PATENT DOCUMENTS

| | | | | |
|---|---|---|---|---|
| JP | S61-045171 | U | 3/1986 | |
| JP | 61045171 | Y2 * | 12/1986 | B41J 35/38 |
| JP | H07-021357 | U | 4/1995 | |
| JP | H09-141987 | A1 | 6/1997 | |
| JP | 2006-150956 | A1 | 6/2006 | |
| JP | 2007-331126 | A1 | 12/2007 | |
| JP | 2015-091645 | A1 | 5/2015 | |
| JP | 2016-141059 | A1 | 8/2016 | |
| JP | 2016141059 | A * | 8/2016 | B41M 5/382 |
| WO | 2013/141313 | A1 | 9/2013 | |

OTHER PUBLICATIONS

International Search Report and Written Opinion (Application No. PCT/JP2017/035020) dated Oct. 31, 2017.

Korean Office Action (with English translation), Korean Application No. 10-2019-7003090, dated Jul. 16, 2020 (18 pages).

* cited by examiner

HEAT TRANSFER SYSTEM, WINDING DEVICE, HEAT TRANSFER METHOD, AND WINDING METHOD

FIELD

The present disclosure relates to a heat transfer system, a winding device, a heat transfer method, and a winding method.

BACKGROUND

There is widely used a heat transfer system that prints a character or an image on a transfer-receiving body such as a card or image receiving paper by using an ink ribbon. The ink ribbon includes a ribbon, or a base layer, that extends like a strip and an ink layer that is formed on the ribbon and contains dye or the like. In printing using the ink ribbon, ink is transferred to the transfer-receiving body in a pattern corresponding to a desired character or image to be printed. In this case, in the ink ribbon having ink transferred therein, there is a portion in which ink is omitted because of transfer to the transfer-receiving body in a pattern corresponding to the printed character or image. Therefore, it is possible to identify the printed character or image from the ink ribbon having ink transferred therein. Accordingly, when confidential information such as ID information is printed on a transfer-receiving body using an ink ribbon, it is necessary to be careful in handling an ink ribbon having ink transferred therein.

In order to deal with this problem, for example, a heat transfer system described in Japanese Utility Model Laid-Open Publication No. H7-21357 heats an ink ribbon with a first heating element to transfer ink in an ink layer to a transfer-receiving body in a first pattern such as a character pattern including ID information, for example, and thereafter heats the ink ribbon having ink transferred therein, which is wound around a winding part, with a second heating element to transfer ink in the ink layer to a support layer, that is, a base layer wound inside the ink layer, in a second pattern that is different from the first pattern.

The heat transfer system described in Japanese Utility Model Laid-Open Publication No. H7-21357 can make it difficult to identify the first pattern from the ink ribbon having ink transferred therein.

However, when ink is transferred to the base layer inside the ink layer in the second pattern by using a thermal-sublimation-type ink ribbon, which is used mainly for printing of photographic images, it has been conventionally difficult to transfer a sufficient amount of ink that can disturb, that is, break the first pattern. The reason therefor is that, in order to transfer thermal-sublimation-type ink with a sufficient color density, a dye-receiving layer is required on a surface of a transfer-receiving body; however, the base layer of the ink ribbon, which is wound to correspond to the inside of the ink layer, does not have the function of the dye-receiving layer.

This is because a heat-resistant back surface layer is provided on the base layer opposite to the ink layer of the ink ribbon because the ink ribbon is heated with a thermal head, and it is difficult to provide the dye-receiving function to this back surface layer. If the dye-receiving function of the ribbon back surface layer is enhanced, there arises a problem that, when an ink ribbon is manufactured, dye transferred to the back surface layer is transferred again to a dye layer of a different screen color, easily causing mixing of colors between dye ribbon screens.

Therefore, conventionally, thermal heat transfer systems have a problem that it is difficult to prevent printed personal information such as a facial photograph from being identified from an ink omission part of a thermal-sublimation-type ink ribbon.

DISCLOSURE OF INVENTION

The present disclosure has been achieved to solve the above problems, and an object of the present disclosure is to provide a heat transfer system, a winding device, a heat transfer method, and a winding method that can prevent printed personal information from being identified from an ink omission part of a thermal-sublimation-type ink ribbon.

In an aspect of the present disclosure, there is provided a heat transfer system that transfers ink to a transfer-receiving body by using an ink ribbon that includes a base layer, an ink layer being on one surface of the base layer and containing a thermal migratory dye, and a back surface layer on the other surface of the base layer, the heat transfer system comprising:

a sending part sending the ink ribbon;

a first heating element heating the ink ribbon from the back surface layer side on a downstream side of the sending part so as to transfer ink in the ink layer to the transfer-receiving body in a first pattern;

a winding part winding the ink ribbon having ink transferred therein on a downstream side of the first heating element in such a manner that the back surface layer is positioned outside the ink layer;

a second heating element near the winding part, configured to heat the ink ribbon after the ink is transferred from the back surface layer side to transfer ink in the ink layer to the back surface layer inside the ink layer in a second pattern that is different from the first pattern; and a controller controlling the first heating element and the second heating element, wherein the controller controls the first heating element to transfer ink corresponding to the first pattern by transferring a portion of the ink layer, and controls the second heating element to transfer ink corresponding to the second pattern by transferring the ink layer as a whole.

It is possible that the back surface layer contains phosphate ester.

It is possible that the back surface layer contains a resin cured by an isocyanate-series curing agent, and an isocyanate-series curing agent that has not yet reacted with the resin.

It is possible that the back surface layer contains a resin cured by an isocyanate-series curing agent, and a molar equivalent ratio between a hydroxyl group in the resin and an isocyanate group in the isocyanate-series curing agent (—NCO/—OH) is 0.5 or less.

It is possible that the resin contains an acetal-series resin.

It is possible that the back surface layer contains an acrylic resin and a silicone resin, and the silicone resin contains at least either an amino-modified silicone resin or a carboxy-modified silicone resin.

It is possible that the controller controls the second heating element to cause the ink ribbon having ink transferred therein to be fused and adhere to an ink ribbon having ink transferred therein that is positioned inside in a portion of the second pattern.

It is possible that the base layer includes a primer layer that is in contact with the ink layer.

It is possible that the primer layer contains inorganic fine particles.

It is possible that the inorganic fine particles are alumina sol or colloidal silica.

It is possible that the primer layer contains a water-based resin.

It is possible that the heat transfer system further comprises a gear-shaped member pressing the ink ribbon having ink transferred therein between the first heating element and the winding part.

It is possible that the winding part includes a cushion layer on its outer circumferential surface.

It is possible that the ink ribbon includes a cushion part in its starting portion.

In an aspect of the present disclosure, there is provided a winding device that winds therearound an ink ribbon including a base layer, an ink layer on one surface of the base layer, and a back surface layer on the other surface of the base layer after ink in the ink layer is transferred to a transfer-receiving body in a first pattern, the winding device comprising:

a winding part winding the ink ribbon having ink transferred therein therearound in such a manner that the back surface layer is positioned outside the ink layer;

a heating element heating the ink ribbon having ink transferred therein from the back surface layer side near the winding part to transfer ink in the ink layer to the back surface layer inside the ink layer in a second pattern that is different from the first pattern; and a controller controlling the heating element, wherein the controller controls the second heating element to transfer ink corresponding to the second pattern by transferring the ink layer as a whole.

In an aspect of the present disclosure, there is provided a heat transfer method of transferring ink to a transfer-receiving body by using an ink ribbon including a base layer, an ink layer on one surface of the base layer, and a back surface layer on the other surface of the base layer, the heat transfer method comprising:

sending the ink ribbon;

heating the sent ink ribbon with a first heating element from the back surface layer side to transfer ink in the ink layer to the transfer-receiving body in a first pattern;

winding the ink ribbon having ink transferred therein in such a manner that the back surface layer is positioned outside the ink layer; and heating the wound ink ribbon having ink transferred therein with a second heating element from the back surface layer side to transfer ink in the ink layer to the back surface layer inside the ink layer in a second pattern that is different from the first pattern, wherein transferring in the first pattern is performed by transferring ink corresponding to the first pattern by transferring a portion of the ink layer, and transferring in the second pattern is performed by transferring ink corresponding to the second pattern by transferring the ink layer as a whole.

In an aspect of the present disclosure, there is provided a winding method of winding an ink ribbon including a base layer, an ink layer on one surface of the base layer, and a back surface layer on the other surface of the base layer after ink in the ink layer is transferred to a transfer-receiving body in a first pattern, the winding method comprising:

winding the ink ribbon having ink transferred therein in such a manner that the back surface layer is positioned outside the ink layer; and heating the wound ink ribbon having ink transferred therein with a heating element from the back surface layer side to transfer ink in the ink layer to the back surface layer inside the ink layer in a second pattern that is different from the first pattern, wherein transferring in the second pattern is performed by transferring ink corresponding to the second pattern as the ink layer as a whole.

According to the present disclosure, it is possible to prevent printed personal information from being identified from an ink omission part of a thermal-sublimation-type ink ribbon.

DESCRIPTION OF EMBODIMENTS

First Embodiment

A first embodiment of the present disclosure is described below with reference to FIGS. 1 to 12. First, an overall configuration of a heat transfer system 10 is described with reference to FIG. 1.

(Heat Transfer System 10)

Figure 1:
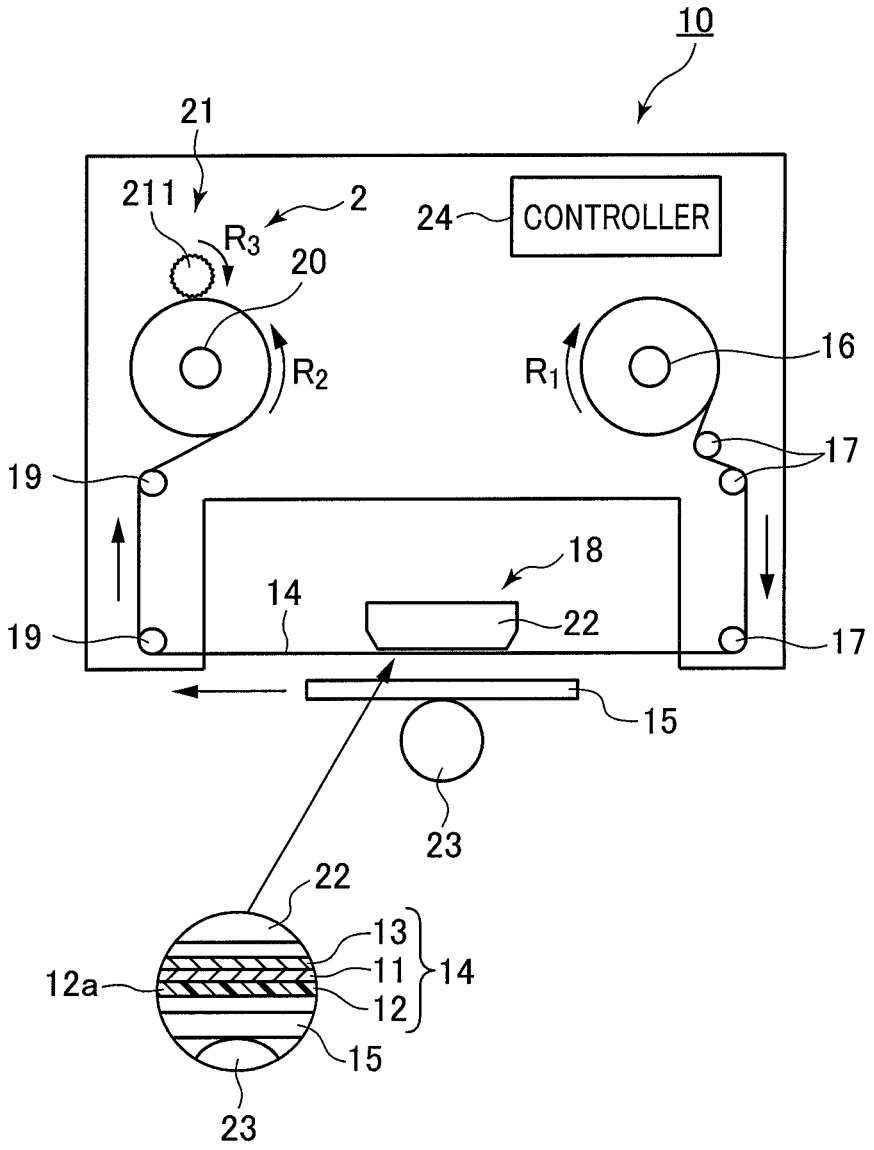
FIG. 1 is a diagram illustrating a heat transfer system according to a first embodiment.

The heat transfer system 10 illustrated in FIG. 1 uses an ink ribbon 14 including a base layer 11, an ink layer 12 on one surface of the base layer 11, and a back surface layer 13 on the other surface of the base layer 11 so as to transfer ink 12*a* to a transfer-receiving body 15 in a desired pattern. The ink ribbon 14 used in the heat transfer system 10 is a thermal-sublimation-type ink ribbon 14 that contains sublimation dye ink 12*a*.

As illustrated in FIG. 1, the heat transfer system 10 includes a sending part 16, a plurality of sending-side guide rollers 17, a first transfer device 18, a plurality of winding-side guide rollers 19, a winding part 20, and a second transfer device 21 in this order from the upstream side in a direction of sending the ink ribbon 14. The first transfer device 18 includes a first heating element 22 and a platen roller 23. The second transfer device 21 includes a second heating element 211. The heat transfer system 10 also includes a controller 24. The winding part 20 and the second transfer device 21 constitute a winding device 2.

(Sending Part 16)

The sending part 16 rotates in a direction illustrated with an arrow $R_1$ in FIG. 1 to send out the ink ribbon 14 to the downstream side.

The sending-side guide rollers 17 are spaced from each other in a direction of transporting the ink ribbon 14. Each sending-side guide roller 17 guides transport of the ink ribbon 14 sent from the sending part 16 to the downstream side.

(First Heating Element 22)

The first heating element 22 and the platen roller 23 are opposed to each other with the ink ribbon 14 on the downstream side of the sending-side guide rollers 17 sandwiched therebetween. The platen roller 23 is opposed to the ink ribbon 14 on the side of the ink layer 12. The platen roller 23 supports the transfer-receiving body 15 transported to a position between the ink layer 12 and the platen roller 23. The first heating element 22 is opposed to the ink ribbon 14 on the side of the back surface layer 13. The first heating element 22 heats the ink ribbon 14 from the side of the back surface layer 13. The first heating element 22 is a thermal head including a heat-generating element that generates heat when current is supplied thereto, for example. The first heating element 22 heats the ink ribbon 14 to transfer the sublimation dye ink 12*a* in the ink layer 12 to the transfer-receiving body 15 in a first pattern, thereby achieving color gradation expression by change of the transfer amount of sublimation dye. The first pattern is an image pattern of an identification document, that is, an ID card, for example, a driver's license, an employee ID card, or a passport photograph. The transfer-receiving body 15 has a function of receiving the sublimation dye ink 12*a*.

By transferring the ink 12*a* in the first pattern, an ink omission part in the first pattern is generated in the ink ribbon 14. A specific example of the ink omission part in the first pattern will be explained in an operation example described later.

The winding-side guide rollers 19 are spaced from each other in the direction of transporting the ink ribbon 14. Each winding-side guide roller 19 guides transport of the ink ribbon 14 having ink transferred therein in the first pattern to the downstream side.

(Winding Part 20)

Figure 2:
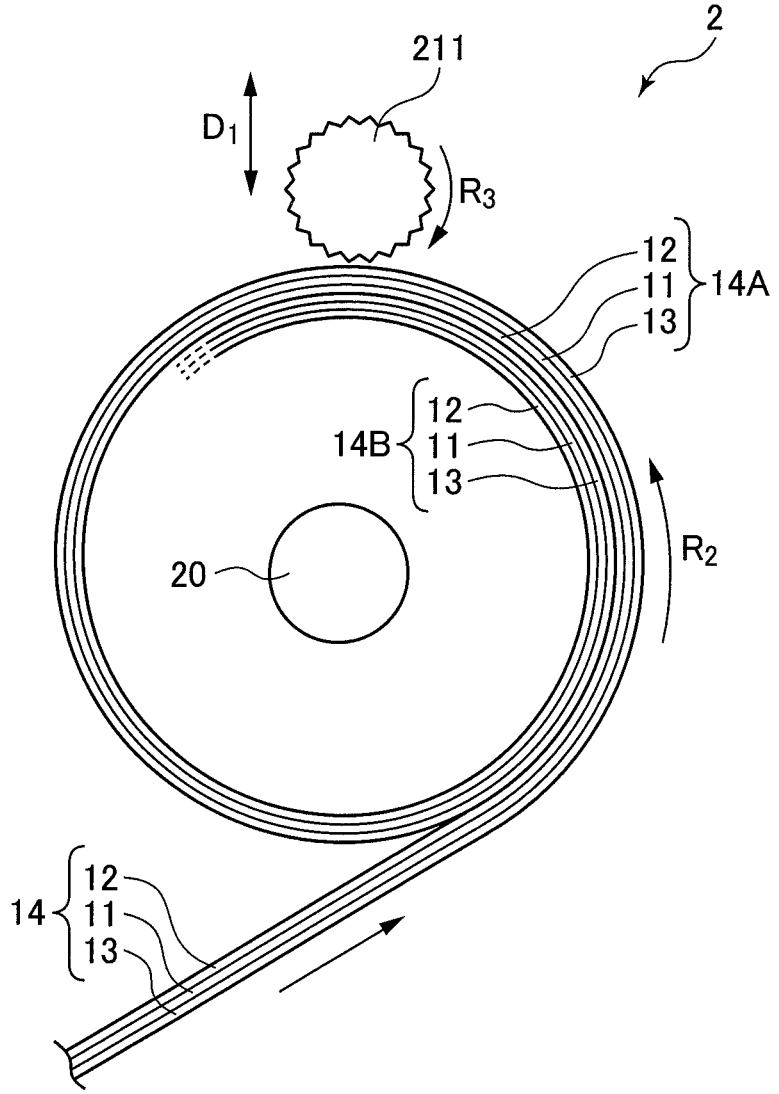
FIG. 2 is an enlarged view illustrating a winding device of the heat transfer system according to the first embodiment.

FIG. 2 is an enlarged view illustrating the winding device 2 of the heat transfer system 10 according to the first embodiment. The winding part 20 of the winding device 2 is a roll-shaped core body, for example. The winding part 20 rotates in a direction illustrated with an arrow $R_2$ in FIGS. 1 and 2 by power of a driving source (not illustrated) such as a motor. The winding part 20 rotates to wind the ink ribbon 14 having ink transferred therein, which has been transported from the winding-side guide rollers 19 around the winding part 20 in such a manner that the ink layer 12 is positioned inside. That is, the winding part 20 winds the ink ribbon 14 having ink transferred therein therearound in such a manner that the back surface layer 13 is positioned outside the ink layer 12 on the downstream side the first heating element 22.

(Second Heating Element 211)

As illustrated in FIGS. 1 and 2, the second heating element 211 is arranged near the winding part 20. The second heating element 211 is roller-shaped and rotates in a direction illustrated with an arrow $R_3$ in FIGS. 1 and 2 by power of a driving source (not illustrated) such as a motor.

Figure 3A:
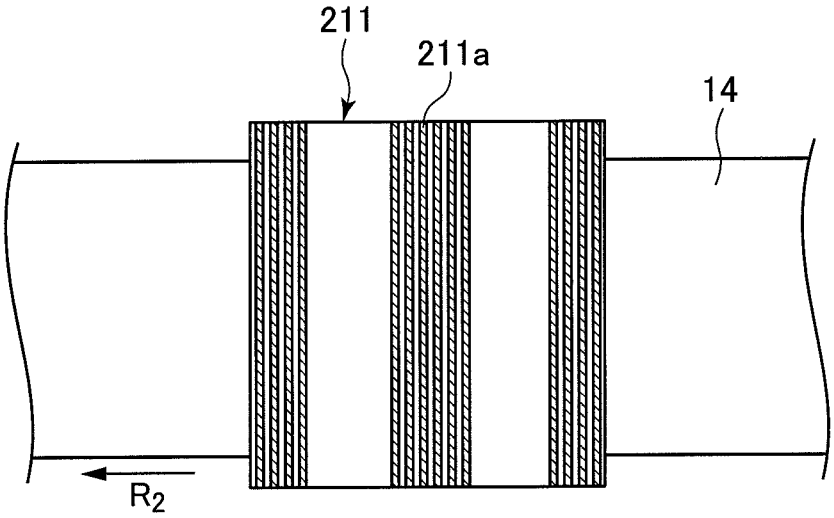
FIG. 3A is a plan view illustrating a second heating element of the heat transfer system according to the first embodiment.
Figure 3B:
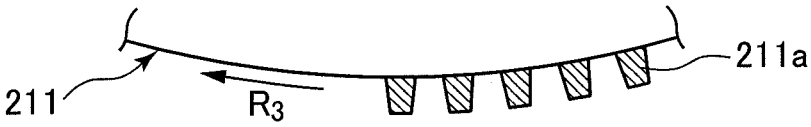
FIG. 3B is a partial enlarged cross-sectional view illustrating the second heating element.

FIG. 3A is a plan view illustrating the second heating element 211 of the heat transfer system 10 according to the first embodiment. FIG. 3B is a partial enlarged cross-sectional view illustrating the second heating element 211. As illustrated in FIGS. 3A and 3B, the second heating element 211 has projections 211*a* arranged on its outer circumferential surface in a second pattern that is different from the first pattern.

The second heating element 211 heats and presses an outer ink ribbon 14A positioned in the outermost circumference of the ink ribbon 14 having ink transferred therein, which has been wound around the winding part 20, by the projections 211*a* from the side of the back surface layer 13. The second heating element 211 is a heating resistor that generates heat when current is supplied thereto, for example. When the outer ink ribbon 14A is heated, the ink 12*a* in the ink layer 12 of the outer ink ribbon 14A is transferred to the back surface layer 13 of an inner ink ribbon 14B that is adjacent to the outer ink ribbon 14A of the ink ribbon 14 wound around the winding part 20 inside the outer ink ribbon 14A. Because the projections 211*a* are arranged in the second pattern, the ink 12*a* in the outer ink ribbon 14A is transferred to the back surface layer 13 of the inner ink ribbon 14B in the second pattern. That is, the second heating element 211 heats the ink ribbon 14A having ink transferred therein from the side of the back surface layer 13 near the winding part 20, thereby transferring the ink 12*a* in the ink layer 12 to the back surface layer 13 inside the ink layer 12 in the second pattern that is different from the first pattern.

By transferring the ink 12*a* in the second pattern that is different from the first pattern, it is possible to form an ink omission part in the second pattern that disturbs, that is, breaks an ink omission part in the first pattern on the outer ink ribbon 14A. Because the ink omission part in the first pattern is disturbed, it is possible to prevent leak of personal information such as face information that is expressed in the first pattern.

As winding of the ink ribbon 14 having ink transferred therein progresses, the outer diameter of a roll configured by the wound ink ribbon 14 increases in the winding part 20. In order to deal with this increase of the outer diameter of the roll, the second heating element 211 is supported by a support mechanism (not illustrated) to be movable in a radial direction D1 of the winding part 20 illustrated in FIG. 2. By supporting the second heating element 211 by the support mechanism, it is possible to move the second heating element 211 in the radial direction D1 to stop contact with the ink ribbon 14 wound around the winding part 20 any time, in a case where winding driving is stopped or a case where heating with the second heating element 211 is unnecessary.

(Controller 24)

The controller 24 controls the first heating element 22 and the second heating element 211. Specifically, the controller 24 controls the first heating element 22 to transfer the ink 12*a* corresponding to the first pattern by transferring a portion of the ink layer 12. Also, the controller 24 controls the second heating element 22 to transfer the ink 12*a* corresponding to the second pattern by transferring the ink layer 12 as a whole.

For example, the controller 24 controls heating temperatures of the heating elements 21 and 22 in such a manner that the second heating element 211 generates heat at a temperature that is a predetermined number of times higher than the first heating element 22, where the predetermined number is larger than 1. The heating temperature to be controlled can be set to a preferable heating temperature based on an experimental result performed in advance, for example.

In the first embodiment, it is ensured that the ink 12*a* corresponding to the second pattern can be transferred as the whole ink layer 12, because the back surface layer 13 contains phosphate ester as described later.

According to the controller 24, it is possible to achieve color gradation expression and ensure printing quality by changing the amount of the sublimation dye ink 12*a* corresponding to the first pattern transferred to the transfer-receiving body 15 when the first pattern is transferred.

Meanwhile, when the second pattern is transferred, the sublimation dye ink 12*a* is transferred as the whole ink layer 12 to the back surface layer 13, that is, abnormal transfer is actively caused. Thus, it is possible to surely prompt migration of the ink 12*a* from the outer ink ribbon 14*a* to the back surface layer 13 of the inner ink ribbon 14B. Therefore, an ink omission part in the second pattern, which disturbs an ink omission part in the first pattern, can be surely formed in the outer ink ribbon 14A, even when the back surface layer 13 does not have a function of receiving sublimation dye. At the same time, because a high-density dye image in the second pattern migrates to the back surface layer 13 as the whole ink layer 12, it is possible to partly cover the ink omission part in the first pattern of the inner ink ribbon 14B, thereby further improving the disturbing effect.

(Ink Ribbon 14)

Figure 4A:
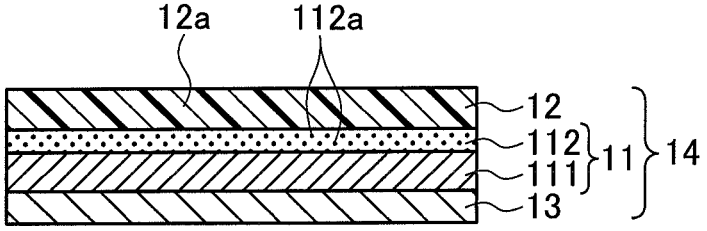
FIG. 4A is a cross-sectional view illustrating an ink ribbon of the heat transfer system according to the first embodiment.
Figure 4B:
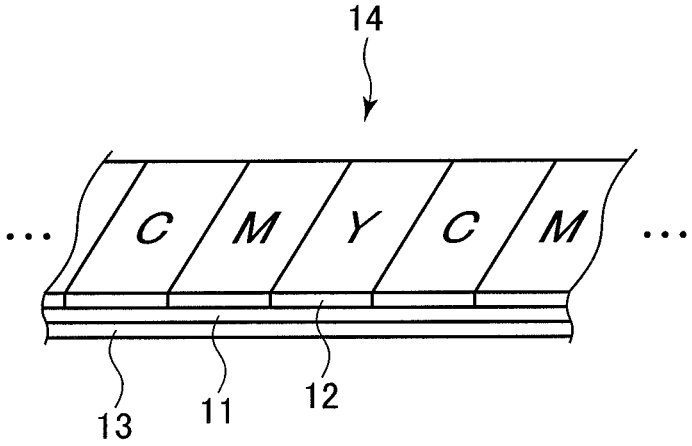
FIG. 4B is a perspective view of the ink ribbon illustrated in FIG. 4A.

FIG. 4A is a cross-sectional view illustrating the ink ribbon 14 of the heat transfer system according to the first embodiment. FIG. 4B is a perspective view of the ink ribbon illustrated in FIG. 4A. As illustrated in FIG. 4A, the ink ribbon 14 is configured by the back surface layer 13, the base layer 11, and the ink layer 12 that are stacked in this order. Further, as illustrated in FIG. 4A, the base layer 11 includes a resin layer 111 that is in contact with the back surface layer 13, and a primer layer 112 that is in contact with the ink layer 12 between the resin layer 111 and the ink layer 12.

(Resin Layer 111)

As the resin layer 111 configuring the base layer 11, various resin films can be used which each have heat resistance and strength with which the resin layer 111 can withstand heat transfer. The resin layer 111 is preferably a polyethylene telephthalate film. The resin layer 111 can be a 1,4-polycyclohexylenedimethylene terephthalate film, a polyethylene naphthalate film, a polyphenylene sulfide film, a polystyrene film, a polypropylene film, a polysulfone film, an aramid film, a polycarbonate film, a polyvinyl alcohol film, a cellophane film, a film of cellulose derivative such as cellulose acetate, a polyethylene film, a polyvinyl chloride film, a nylon film, a polyimide film, or an ionomer film, for example. The resin layer 111 may contain two or more of the resins listed above.

(Primer Layer 112)

The primer layer 112 is provided to improve adhesiveness of the ink layer 12 to the base layer 11, for example. The primer layer 112 contains a thermoplastic resin and inorganic fine particles 112*a*. The inorganic fine particles 112*a* in the primer layer 112 are preferably colloidal silica or alumina sol. By employing colloidal silica or alumina sol, adhesiveness to the ink layer 12 can be surely enhanced. The inorganic fine particles 112*a* can be silica other than colloidal silica, for example, colloidal alumina, cationic aluminum oxide, or its hydrate, alumina hydrate other than alumina sol, such as pseudoboehmite, aluminum silicate, magnesium silicate, magnesium carbonate, magnesium oxide, or titanium oxide, for example. The primer layer 112 can contain the same kind of inorganic fine particles 112*a* only, or can contain different kinds of inorganic fine particles 112*a*. The thermoplastic resin in the primer layer 112 is a hydrophilic resin, that is, a water-based resin. A polyvinylpyrrolidone resin or a polyvinyl alcohol resin among hydrophilic resins can be suitably used, because the adhesiveness between the resin layer 111 and the ink layer 12 is satisfactory and the dyeing property of the ink layer 12 is low. The hydrophilic resin can be a polyester-series resin, a polyacrylic ester-series resin, a polyurethane-series resin, a styrene acrylate resin, a cellulose resin such as ethyl cellulose, hydroxyethyl cellulose, ethyl hydroxy cellulose, hydroxypropyl cellulose, methylcellulose, cellulose acetate, and cellulose butyrate, or a polyvinyl acetal resin such as polyvinyl acetoacetal and polyvinyl butylal, for example. The primer layer 112 can only contain one kind of resin among the water-based resins listed above or can contain two or more kinds of resins.

The primer layer 112 can be formed by applying a coating in which inorganic fine particles are dispersed in a sol state in an aqueous solvent such as a mixture of alcohol and water and a thermoplastic resin is dispersed or dissolved in the aqueous solvent, by gravure coating, roll coating, screen printing, or reverse roll coating that uses a gravure cylinder, for example, and then drying the coating.

(Ink Layer 12)

The ink layer 12, that is, a dye layer can be a single layer of one color, or a plurality of ink layers 12 containing ink or dye of different colors that have hues CMY can be formed on the same surface of the base layer 11 repeatedly in a panel sequential manner, as illustrated in FIG. 4B. The ink layer 12 is a layer in which thermal migratory dye is supported by any binder. As the ink 12*a* in the ink layer 12, various types of sublimation dye ink that cause sublimation and migration by heat can be used. Thermal sublimation ink is suitable for image printing, whereas thermofusible ink is suitable for character printing. Examples of the ink 12*a* in the ink layer 12 include diarylmethane-series ink, triarylmethane-series ink, thiazole-series ink, methine-series ink such as merocyanine and pyrazolone methine, azomethine-series ink typically exemplified by indoaniline, acetophenone azomethine, pyrazoloazomethine, imidazole azomethine, imidazo azomethine, and pyridone azomethine, xanthene-series ink, oxazine-series ink, cyanomethylene-series ink typically exemplified by dicyanostyrene and tricyanostyrene, thiazine-series ink, azine-series ink, acridine-series ink, benzene azo-series ink, azo-series ink such as pyridone azo, thiophene azo, isothiazole azo, pyrol azo, pyralazo, imidazole azo, thiadiazole azo, triazole azo, and disazo, spiropyran-series ink, indolinospiropyran-series ink, fluoran-series ink, rhodaminelactam-series ink, naphthoquinone-series ink, anthraquinone-series ink, and quinophthalon-series ink.

As the binder in the ink layer 12, a cellulose-series resin such as ethyl cellulose, hydroxyethyl cellulose, ethyl hydroxy cellulose, hydroxypropyl cellulose, methylcellulose, cellulose acetate, and cellulose butyrate, a vinyl-series resin such as polyvinyl alcohol, polyvinyl acetate, polyvinyl butylal, polyvinyl acetal, polyvinylpyrrolidone, and polyacrylamide, a polyester-series resin, and a phenoxy resin can be preferably used, for example.

The ink layer 12 can be formed by preparing a coating by adding the ink 12*a* and the binder described above, and an additive such as a silane coupling agent as necessary, into an appropriate solvent and dissolving or dispersing the constituents in the solvent, and thereafter applying this coating on the base layer 11 and drying the applied coating, for example. The application method of the coating can be rotogravure, screen printing, or reverse roll coating that uses a gravure cylinder, for example.

(Back Surface Layer 13)

The back surface layer 13 is provided to prevent influences of sticking and print wrinkles due to heat of the first heating element 22, for example. The back surface layer 13 contains a resin and an additive. The additive can be added into the resin or be coated on the resin. In order to improve adhesiveness to the ink layer 12, it is preferable that the resin in the back surface layer 13 is the same resin as the binder in the ink layer 12. Examples of the same resin as the binder in the ink layer 12 include a polyvinyl acetal-series resin such as a polyvinyl acetoacetal resin and a polyvinyl butylal resin. The resin in the back surface layer 13 can be a polyester resin, vinyl chloride-vinyl acetate copolymer, a polyether resin, a polybutadiene resin, styrene-butadiene copolymer, polyol such as a polyalcohol polymer compound, acrylic polyol, polyurethane acrylate, polyester acrylate, polyether acrylate, epoxy acrylate, urethane or epoxy prepolymer, a nitrocellulose resin, a cellulose nitrate resin, a cellulose acetate propionate resin, a cellulose acetate butyrate resin, a cellulose acetate hydrogen phthalate resin, a cellulose acetate resin, an aromatic polyamide resin, a polyimide resin, a polyamideimide resin, a polycarbonate resin, or a chlorinated polyolefin resin, for example.

The back surface layer 13 contains phosphate ester as the additive in order to prompt transfer of the ink layer 12 of the outer ink ribbon 14A to the back surface layer 13 of the inner ink ribbon 14B in the second pattern. Because the back surface layer 13 contains phosphate ester, phosphate ester migrates from the back surface layer 13 of the inner ink ribbon 14B to the outer ink ribbon 14A when the ink ribbon 14 is heated, so that adhesiveness between the ink layer 12 of the outer ink ribbon 14A and the primer layer 112 can be reduced. Therefore, it is possible to more surely transfer the ink layer 12 in the second pattern. The content of phosphate ester with regard to the total mass of the back surface layer 13 is preferably 5 mass % or more and 50 mass % or less, and is more preferably 10 mass % or more and 30 mass % or less.

It can be demonstrated that the back surface layer 13 contains phosphate ester by surface analysis of the back surface layer 13 to detect physical properties derived from phosphate ester described in the following (a) and (b), for example.

(a) Element P is 0.25 mass % or more in surface analysis, that is, element mapping by energy dispersive X-ray spectrometry (EDX).

(b) Characteristic absorbed bands appear around 1028 (P—O—C stretching), 1105 (P—OH stretching), and 1244 (P═O stretching) $cm^{-1}$ in the infrared absorption spectrum.

The measurement conditions of energy dispersive X-ray spectrometry in (a) are as follows.

Analysis device: scanning electron microscope/energy dispersive X-ray spectrometry (SEM/EDX)

Acceleration voltage: 20 kV

Magnification: 500 times (scanning in the entire field of view 200 μm×250 μm)

The measurement conditions of infrared absorption spectrum in (b) are as follows.

Analysis device: Fourier transform infrared spectrophotometer (FT-IR)

Measurement method: ATR (germanium)

Resolution: 4 $cm^{-1}$

Cumulative number: 32 times

As an additive other than phosphate ester, the back surface layer 13 can contain a cross-linking agent and/or filler. Further, the back surface layer 13 can contain a silicone resin. The silicone resin is preferably at least either amino-modified silicone or carboxy-modified silicone.

The back surface layer 13 can be formed by preparing a coating of a heat-resistant slipping layer by dissolving or dispersing the resin and the additive described above in an appropriate solvent, applying this coating on the base layer 11 by rotogravure, screen printing, or reverse roll coating that uses a gravure cylinder, for example, and drying the coating.

Operation Example

Next, an operation example of the heat transfer system 10 configured as described above is described. First, a transporting device (not illustrated) of the transfer-receiving body 15 transports the transfer-receiving body 15 to a position between the first heating body 22 and the platen roller 23. Meanwhile, the sending part 16 rotates in the direction $R_1$ in FIG. 1 to send out the ink ribbon 14 downward, and the winding part 20 rotates in the direction $R_2$ in FIG. 1 to wind the ink ribbon 14 therearound. The ink ribbon 14 sent out from the sending part 16 passes through the sending-side guide rollers 17 and reaches a position between the first heating element 22 and the platen roller 23.

The first heating element 22 presses the ink ribbon 14 that has reached the position between the first heating element 22 and the platen roller 23 against the transfer-receiving body 15 on the platen roller 23. At this time, the controller 24 controls the first heating element 22 to generate heat in accordance with the first pattern. This control can be control of current to a heat-generating element. Further, the controller 24 controls the first heating element 22 to transfer the ink 12*a* corresponding to the first pattern by transferring a portion of the ink layer 12, as control that causes the first heating element 22 to generate heat. That is, the controller 24 causes the first heating element 22 to generate heat at a suppressed temperature at which abnormal transfer of the ink layer 12 does not occur.

Figure 5A:
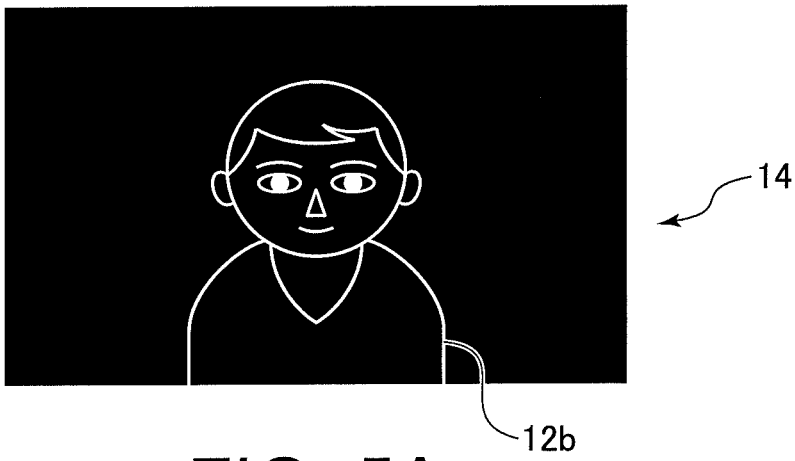
FIG. 5A is a plan view illustrating the ink ribbon having ink transferred therein in a first pattern in an operation example of the heat transfer system according to the first embodiment.
Figure 5B:
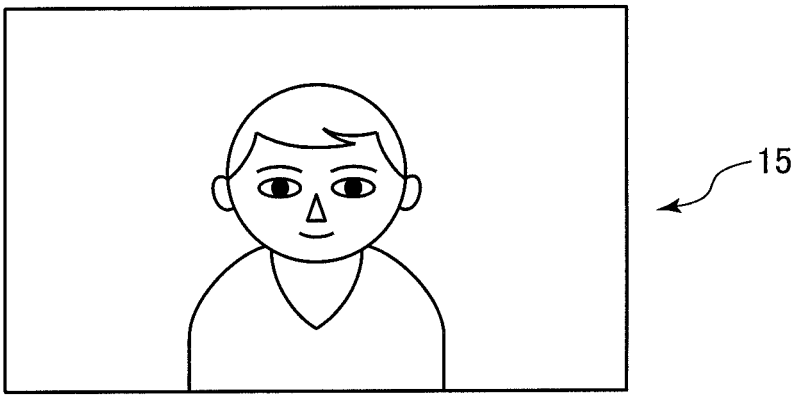
FIG. 5B is a plan view illustrating a transfer-receiving body to which ink has been transferred in the first pattern.
Figure 5C:
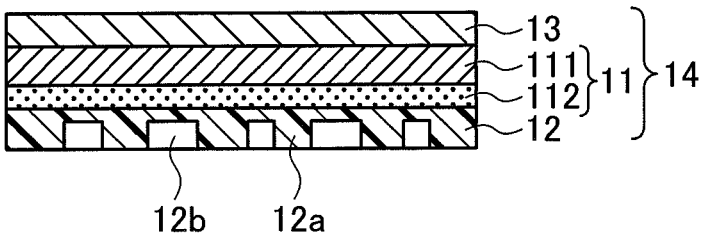
FIG. 5C is a cross-sectional view illustrating the ink ribbon having ink transferred therein in the first pattern.

FIG. 5A is a plan view illustrating the ink ribbon 14 having ink transferred therein in the first pattern in the operation example of the heat transfer system 10 according to the first embodiment. FIG. 5B is a plan view illustrating the transfer-receiving body 15 to which ink has been transferred in the first pattern. FIG. 5C is a cross-sectional view illustrating the ink ribbon 14 having ink transferred therein in the first pattern.

The first heating element 22 is controlled by the controller 24 to transfer a portion of the ink 12*a* in the ink layer 12 of the ink ribbon pressed against the transfer-receiving body 15 to the transfer-receiving body 15 in accordance with the first pattern. Therefore, a facial photograph image of a human, which is an example of the first pattern, is printed on the transfer-receiving body 15, as illustrated in FIG. 5B, for example. By transferring the ink 12*a* to the transfer-receiving body 15 in the first pattern, an ink omission part 12*b*, that is, a print mark in the first pattern is formed in the ink ribbon 14, as illustrated in FIGS. 5A and 5C.

The ink ribbon 14 having ink transferred therein in the first pattern is transported to the downstream side of the first heating element 22, passes through the winding-side guide rollers 19, and is wound around the winding part 20. As illustrated in FIG. 2, in the winding part 20, the ink ribbon 14 having ink transferred therein is wound around the outer circumference of the winding part 20 in such a manner that the ink layer 12 is positioned inside and the back surface layer 13 is positioned outside. Because the ink ribbon 14 is wound in this manner, the back surface layer 13 of the outer ink ribbon 14A faces the second heating element 211, and the ink layer 12 of the outer ink ribbon 14A comes into contact with the back surface layer 13 of the inner ink ribbon 14B.

Figure 6A:
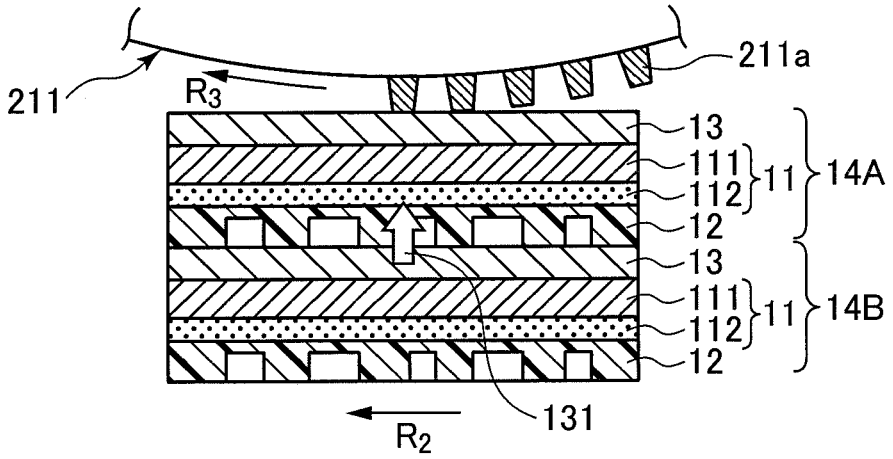
FIG. 6A is a cross-sectional view schematically illustrating migration of phosphate ester from a back surface layer of an inner ink ribbon to an outer ink ribbon in the operation example of the heat transfer system according to the first embodiment.
Figure 6B:
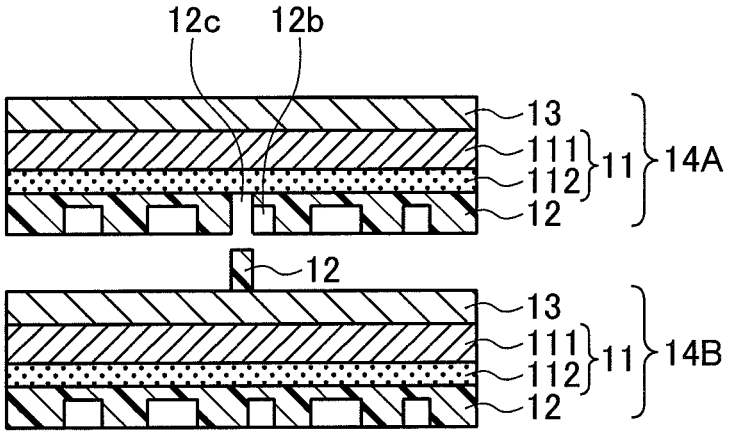
FIG. 6B is a cross-sectional view schematically illustrating a state of ink transfer in a second pattern to the back surface layer of the inner ink ribbon.

FIG. 6A is a cross-sectional view schematically illustrating migration of phosphate ester 131 from the back surface layer 13 of the inner ink ribbon 14B to the outer ink ribbon 14A in the operation example of the heat transfer system 10 according to the first embodiment. FIG. 6B is a cross-sectional view schematically illustrating a state of ink transfer in the second pattern to the back surface layer 13 of the inner ink ribbon 14B. Although FIG. 6B illustrates a state where the inner ink ribbon 14B and the outer inter ribbon 14A are spaced from each other for easier understanding of the ink transfer state, the both ink ribbons 14A and 14B are actually in contact with each other on the outer circumference of the winding part 20.

As illustrated in FIG. 6A, the second heating element 211 abuts the back surface layer 13 of the outer ink ribbon 14A via the projections 211*a* of the second heating element 211. At this time, the controller 24 controls the second heating element 211 to generate heat in accordance with the second pattern that is different from the first pattern. This control can be control of current to the first heating element 22. Further, the controller 24 controls the second heating element 211 to transfer the ink 12*a* corresponding to the second pattern as the whole ink layer 12, as control that causes the second heating element 211 to generate heat. That is, the controller 24 causes the second heating element 211 to generate heat at a temperature at which abnormal transfer of the ink layer 12 occurs. In a case of using the ink ribbon 14 according to the first embodiment, the phosphate ester 131 contained in the back surface layer 13 as described later migrates to the outer ink ribbon 14A, lowering adhesiveness between the primer layer 112 and the ink layer 12 of the outer ink ribbon 14A. Therefore, it is possible to cause abnormal transfer of the ink layer 12 to occur at a relatively low temperature. At this time, it is preferable that the controller 24 causes the second heating element 211 to generate heat at a temperature of 170° C. or more and 200° C. or less.

Because of heat generation with the second heating element 211 at the temperature controlled by the controller 24, as illustrated in FIG. 6A, the phosphate ester 131 migrates from the back surface layer 13 of the inner ink ribbon 14B to the outer ink ribbon 14A. The phosphate ester 131 that has migrated to the outer ink ribbon 14A reacts with the primer layer 112 of the outer ink ribbon 14A, for example, thereby lowering adhesiveness between this primer layer 112 and the ink layer 12 of the outer ink ribbon 14A. Because of lowering of adhesiveness between the primer layer 112 and the ink layer 12, as illustrated in FIG. 6B, the ink 12*a* in the outer ink ribbon 14A corresponding to the second pattern is transferred by transferring the ink layer 12 as a whole to the back surface layer 13 of the inner ink ribbon 14B.

In another embodiment, the primer layer 112 can be configured in such a manner that adhesiveness between the primer layer 112 and the resin layer 111 is lowered by the phosphate ester 131. In this case, the ink 12*a* in the outer ink ribbon 14A corresponding to the second pattern is transferred by transferring the ink layer 12 and the primer layer 112 as a whole to the back surface layer 13 of the inner ink ribbon 14B, so that the same advantageous effects can be obtained.

Figure 7:
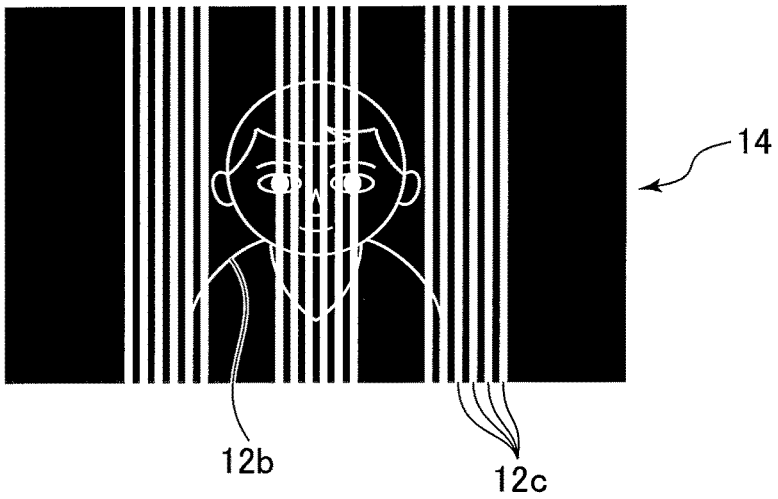
FIG. 7 is a plan view illustrating the ink ribbon having ink transferred therein in the second pattern in the operation example of the heat transfer system according to the first embodiment.

FIG. 7 is a plan view illustrating the ink ribbon 14 having ink transferred therein in the second pattern in the operation example of the heat transfer system 10 according to the first embodiment. By transferring the ink layer 12 in the second pattern, the ink omission part 12*c* in the second pattern is formed in the ink layer 12 of the outer ink ribbon 14A to disturb the ink omission part 12*b* in the first pattern, as illustrated in FIG. 7. Therefore, it is possible to prevent the first pattern from being identified in the ink layer 12 of the outer ink ribbon 14A.

Accordingly, according to the first embodiment, it is possible to prevent printed personal information from being identified from the ink omission part 12*b* of the thermal-sublimation-type ink ribbon 14.

Further, according to the first embodiment, when the back surface layer 13 that contains phosphate ester is used, it is possible to cause phosphate ester to migrate from the back surface layer 13 of the inner ink ribbon 14B to the outer ink ribbon 14A, thereby lowering adhesiveness between the ink layer 12 of the outer ink ribbon 14A and the primer layer 112. Therefore, it is possible to achieve sublimation transfer of the ink 12*a* in the ink layer 12 of the outer ink ribbon 14A to the back surface layer 13 of the inner ink ribbon 14B in the second pattern more surely, so that the ink omission part 12*b* in the first pattern can be more surely disturbed by the ink omission part 12*c* in the second pattern.

Further, in the first embodiment, phosphate ester can prompt transfer of the ink layer 12*a* in the outer ink ribbon 14A. Therefore, unlike a second embodiment described later, the curing degree of the back surface layer 13 can be also increased. By increasing the curing degree of the back surface layer 13, it is possible to prevent adhesion between the ink ribbons 14 wound around the winding part 20. Because adhesion between the ink ribbons 14 can be prevented, it is possible to rewind the wound ink ribbon 14 toward the first heating element 22. Therefore, it is possible to perform heat transfer recording in a mode in which the ink ribbon 14 is made to reciprocate with respect to the first heating element 22.

In order to perform heat transfer recording in the mode in which the ink ribbon 14 is made to reciprocate, the back surface layer 13 can contain a cross-linking agent that has not yet reacted with the resin. The cross-linking agent can be an isocyanate-series curing agent. When the back surface layer 13 contains the cross-linking agent that has not yet reacted with the resin, it is possible to suppress blocking between the back surface layer 13 of the inner ink ribbon 14B and the ink layer 12 of the outer ink ribbon 14A caused by heat generation with the second heating element 211. Therefore, it is possible to prevent adhesion between the inner ink ribbon 14B and the outer ink ribbon 14A further effectively to perform heat transfer recording in the mode in which the ink ribbon 14 is made to reciprocate further appropriately.

(First Modification)

Figure 8:
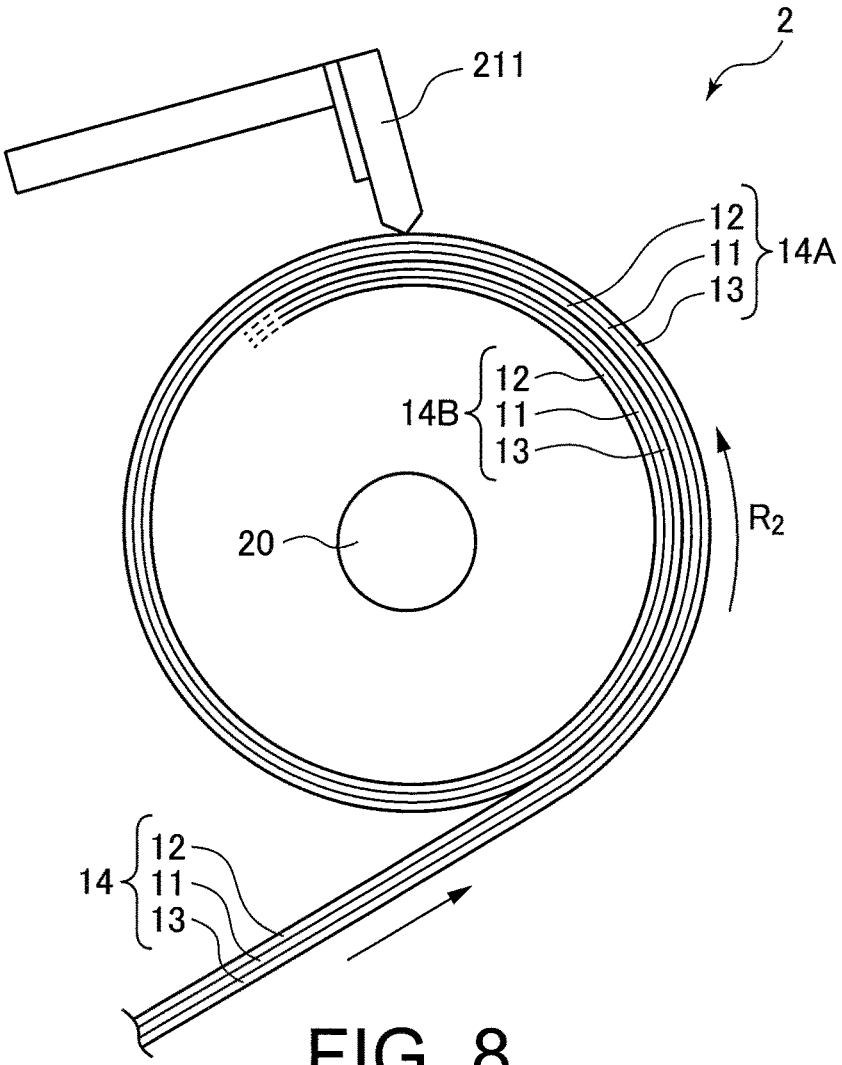
FIG. 8 is an enlarged view illustrating a winding device of a heat transfer system according to a first modification of the first embodiment.

FIG. 8 is an enlarged view illustrating the winding device 2 of the heat transfer system 10 according to a first modification of the first embodiment.

In FIGS. 3A and 3B, the roll-shaped second heating element 211 including the projections 211*a* has been described. Meanwhile, as illustrated in FIG. 8, the second heating element 211 can be a mode of a thermal head in which a plurality of heat-generating elements (not illustrated) are arranged along a direction perpendicular to the drawing of FIG. 8. Unlike the second heating element 211 in FIGS. 3A and 3B of which the temperature is uniform, the second heating element 211 in the mode of a thermal head can cause each heat-generating element to generate heat at an independent temperature by applying independent current-application energy to each heat-generating element. Because each heat-generating element can be caused to generate heat at an independent temperature, the second heating element 211 in FIG. 8 can transfer the second pattern having a more complicated shape than the second heating element 211 in FIGS. 3A and 3B. Further, it is possible to transfer the second patterns having various shapes by causing the heat-generating elements to generate heat in various heat-generating patterns.

Figure 9A:
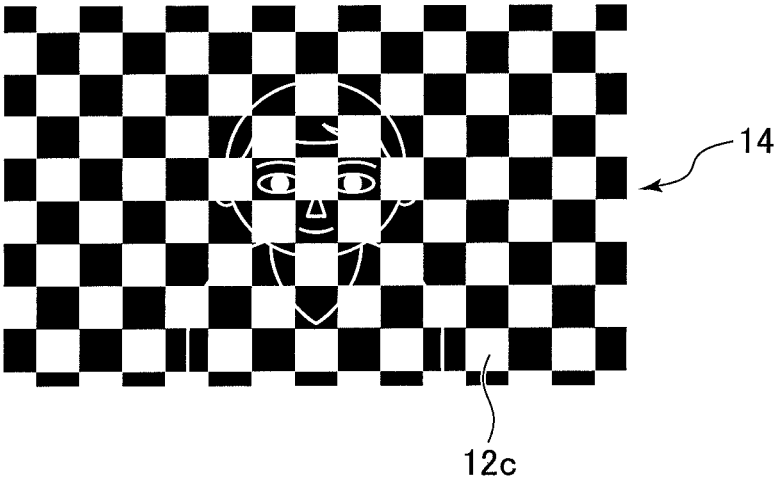
FIG. 9A is a plan view illustrating a first example of the ink ribbon having ink transferred therein in the second pattern in the operation example of the heat transfer system according to the first modification of the first embodiment.
Figure 9B:
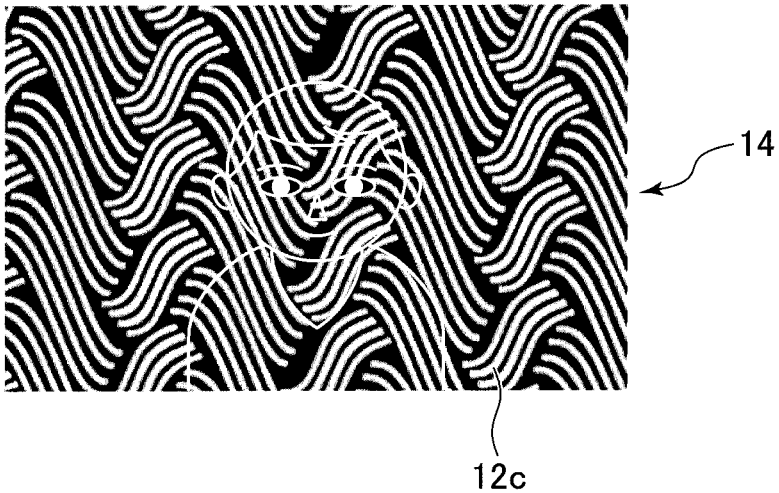
FIG. 9B is a plan view illustrating a second example of the ink ribbon having ink transferred therein in the second pattern.

FIG. 9A is a plan view illustrating a first example of the ink ribbon 14 having ink transferred therein in the second pattern in the operation example of the heat transfer system 10 according to the first modification of the first embodiment. FIG. 9B is a plan view illustrating a second example of the ink ribbon 14 having ink transferred therein in the second pattern.

For example, the second heating element 211 of the first modification can transfer the second pattern that is a checkered pattern, as illustrated with the ink omission part 12*c* in FIG. 9A. The second heating element 211 can also transfer the second pattern that has a waveform shape, as illustrated with the ink omission part 12*c* in FIG. 9B. The ink omission parts 12*c* of these second patterns disturb the first pattern more satisfactorily than the ink omission part 12*c* of the strip-shaped second pattern obtained by the projections 211*a* illustrated in FIG. 7.

Therefore, according to the first modification, it is possible to more surely prevent printed personal information from being identified from the ink omission part 12*b* of the thermal-sublimation-type ink ribbon 14.

(Second Modification)

Figure 10:
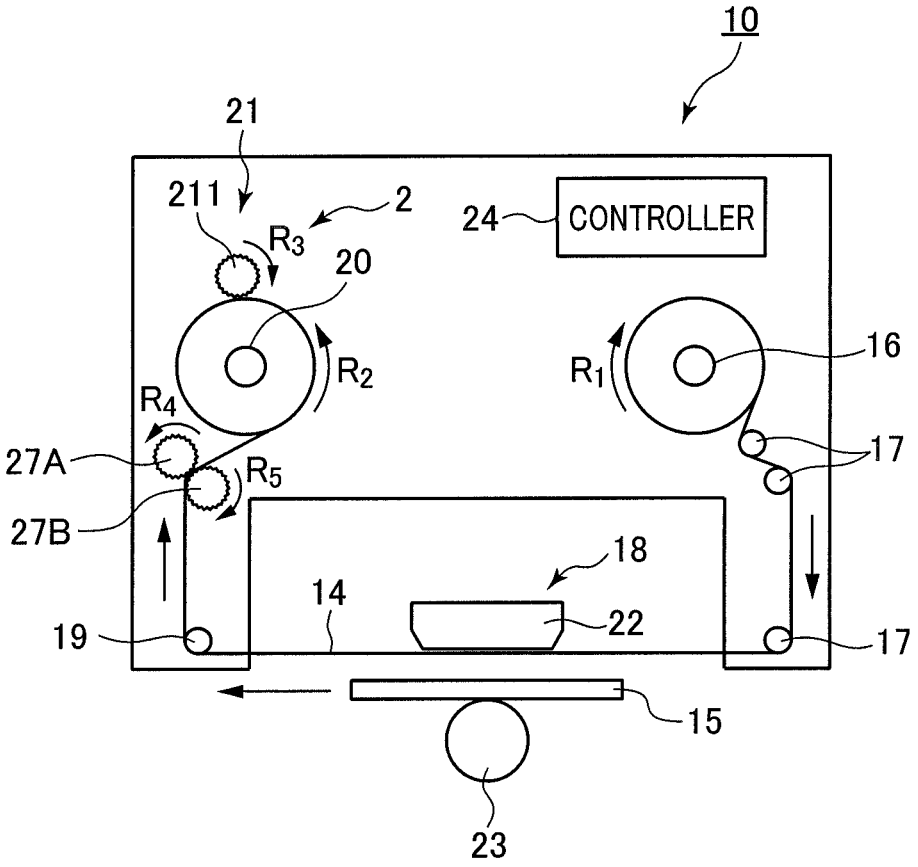
FIG. 10 is a diagram illustrating a heat transfer system according to a second modification of the first embodiment.

FIG. 10 is a diagram illustrating the heat transfer system 10 according to a second modification of the first embodiment. As illustrated in FIG. 10, the heat transfer system 10 can include two gears 27A and 27B that press the ink ribbon 14 having ink transferred therein between the first heating element 22 and the winding part 20.

The gears 27A and 27B in FIG. 10 rotate in different directions $R_4$ and $R_5$ from each other while sandwiching the ink ribbon 14 having ink transferred therein therebetween. The power of the gears 27A and 27B such as a motor can be one. Because the both gears 27A and 27B engage with each other, when the power is transmitted to one of the gears 27A and 27B, rotation of the one gear 27A or 27B is transmitted to the other gear 27A or 27B. By making the power of the gears 27A and 27B in common, the cost can be reduced. The positions of the gears 27A and 27B are not limited to those illustrated in FIG. 10, but can be any positions between the first heating element 22 and the winding part 20.

According to the gears 27A and 27B, it is possible to damage the ink layer 12 by pressing the ink ribbon 14. By damaging the ink layer 12, adhesiveness between the ink layer 12 and the primer layer 112 can be further reduced. Therefore, it is possible to cause abnormal transfer of the ink layer 12 by the second heating element 211 to occur more surely.

According to the second modification, transfer of the ink layer 12 in the second pattern by the second heating element 211 can be performed more surely. Therefore, it is possible to more surely prevent printed personal information from being identified from the ink omission part 12*b* in the first pattern.

(Third Modification)

Figure 11:
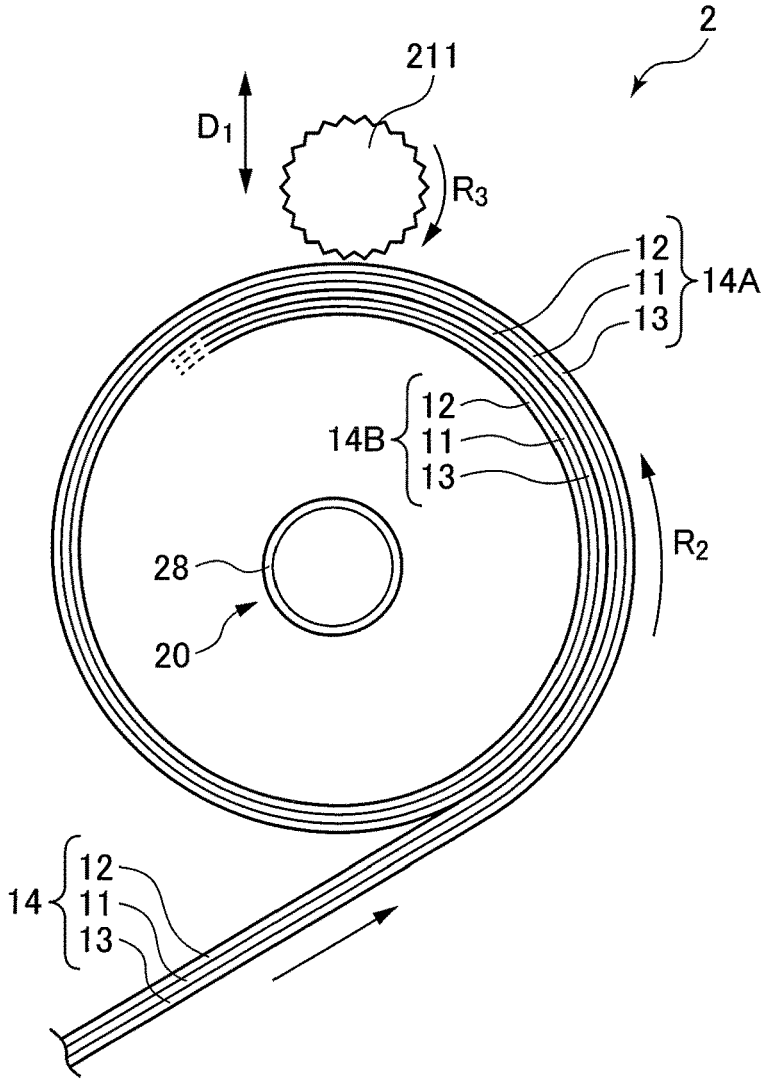
FIG. 11 is an enlarged view illustrating a winding device of a heat transfer system according to a third modification of the first embodiment.

FIG. 11 is an enlarged view illustrating the winding device 2 of the heat transfer system 10 according to a third modification of the first embodiment. The description of FIG. 2 has exemplified the winding part 20 in the mode in which it winds the ink ribbon 14 directly around its core body. Meanwhile, as illustrated in FIG. 11, the winding part 20 can include a cushion layer 28 on the outer circumferential surface of the core body of the winding part 20. For example, the cushion layer 28 may contain an elastic material such as resin foam or rubber.

A starting portion of the ink ribbon 14 is wound around the winding part 20 without any ink ribbon 14 existing inside. Because no ink ribbon 14 exists inside, phosphate ester that prompts transfer of the ink layer 12 from the back surface layer 13 of the inner ink ribbon 14B does not migrate to the starting portion of the ink ribbon 14.

Meanwhile, because the winding part 20 includes the cushion layer 28, the starting portion of the ink ribbon 14 can be wound around the winding part 20 with elasticity. Because the starting portion of the ink ribbon 14 has elasticity, the second heating element 211 can more stably press the ink ribbon 14, as compared with a case where the starting portion of the ink ribbon 14 is wound directly around the core body. Because the ink ribbon 14 can be stably pressed, adhesiveness between the ink layer 12 in the starting portion of the ink ribbon 14 and the cushion layer 28 can be ensured. Because adhesiveness can be ensured, it is possible to surely transfer the ink layer 12 in the starting portion of the ink ribbon 14 to the cushion layer 28.

Therefore, according to the third modification, transfer of the ink layer 12 in the starting portion of the ink ribbon 14 by the second heating element 211 can be performed surely. Accordingly, it is possible to surely prevent printed personal information from being identified from the ink omission part 12*b* in the first pattern even in the starting portion of the ink ribbon 14.

(Fourth Modification)

Figure 12:
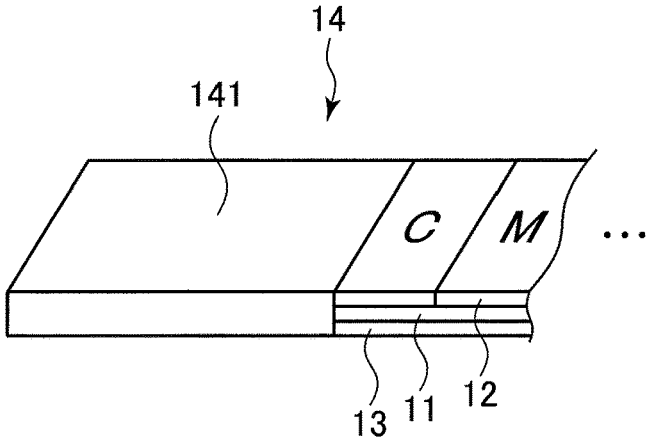
FIG. 12 is a perspective view illustrating an ink ribbon in a heat transfer system according to a fourth modification of the first embodiment.

FIG. 12 is a perspective view illustrating the ink ribbon 14 in the heat transfer system 10 according to a fourth modification of the first embodiment. As illustrated in FIG. 12, a lead film 141 as a cushion part can be provided in the starting portion of the ink ribbon 14. The lead film 141 may be the same resin as the base layer 11 or may contain an elastic material such as resin foam or rubber. Similarly to the third modification, by providing the lead film 141, it is possible to stably press the starting portion of the ink ribbon 14 by the second heating element 211. Accordingly, because adhesiveness between the ink layer 12 in the starting portion of the ink ribbon 14 and the cushion layer 28 can be ensured, it is possible to surely transfer the ink layer 12 in the starting portion of the ink ribbon 14 to the cushion layer 28.

Therefore, according to the fourth modification, similarly to the third modification, transfer of the ink layer 12 by the second heating element 211 can be performed more surely, so that it is possible to more surely prevent printed personal information from being identified from the ink omission part 12*b* in the first pattern.

Second Embodiment

In the first embodiment, there has been described an embodiment in which transfer of the ink layer 12 from the outer ink ribbon 14A to the inner ink ribbon 14B is prompted by phosphate ester contained in the back surface layer 13. Meanwhile, in a second embodiment, the heat transfer system 10 is configured to prompt transfer of the ink layer 12 from the outer ink ribbon 14A to the inner ink ribbon 14B by suppressing the degree of curing by a curing agent in the back surface layer 13. This configuration is specifically described below.

In the second embodiment, the back surface layer 13 contains a resin cured by an isocyanate-series agent. The resin contains a polyvinyl acetal-series resin such as a polyvinyl acetoacetal resin and a polyvinyl butylal resin. The isocyanate-series curing agent causes cross-linking of an acetal-series resin by using its hydroxyl group, thereby improving coating strength or heat resistance of the back surface layer 13.

The isocyanate-series curing agent can be a polyisocyanate resin, for example. Examples of polyisocyanate resin include aromatic polyisocyanate, for example, 2,4-toluene diisocyanate, 2,6-toluene diisocyanate, a mixture of 2,4-toluene diisocyanate and 2,6-toluene diisocyanate, 1,5-naphthalene diisocyanate, tolidine diisocyanate, p-phenylene diisocyanate, trans-cyclohexane, 1,4-diisocyanate, xylylene diisocyanate, triphenylmethane triisocyanate, tris (isocyanate phenyl) thiophosphate, and a mixture of these materials.

A molar equivalent ratio between a hydroxyl group in the resin in the back surface layer 13 and an isocyanate group in an isocyanate-series curing agent (—NCO/—OH) is larger than 0 and is 0.5 or smaller. When the molar equivalent ratio (—NCO/—OH) is larger than 0.5, the curing degree of the back surface layer 13 of the inner ink ribbon 14B is large. Therefore, it is difficult to make adhesive strength between the back surface layer 13 of the inner ink ribbon 14B and the ink layer 12 of the outer ink ribbon 14A to be transferred to this back surface layer 13 sufficiently high. On the other hand, when the molar equivalent ratio (—NCO/—OH) is set to 0.5 or less, it is possible to suppress the curing degree of the back surface layer 13, so that the adhesive strength between the back surface layer 13 of the inner ink ribbon 14B and the ink layer 12 of the outer ink ribbon 14A can be made sufficiently high. Because this adhesive strength is higher than adhesive strength between the ink layer 12 of the outer ink ribbon 14A and the primer layer 112, the ink layer 12 of the inner ink ribbon 14B can be transferred to the back surface layer 13 of the outer ink ribbon 14A.

The back surface layer 13 may contain a polygonal organic filler such as a silicone resin filler or a fluorine-series resin filler. Because of the contained polygonal organic filler, matters adhering to a thermal head can be scraped away.

Figure 13A:
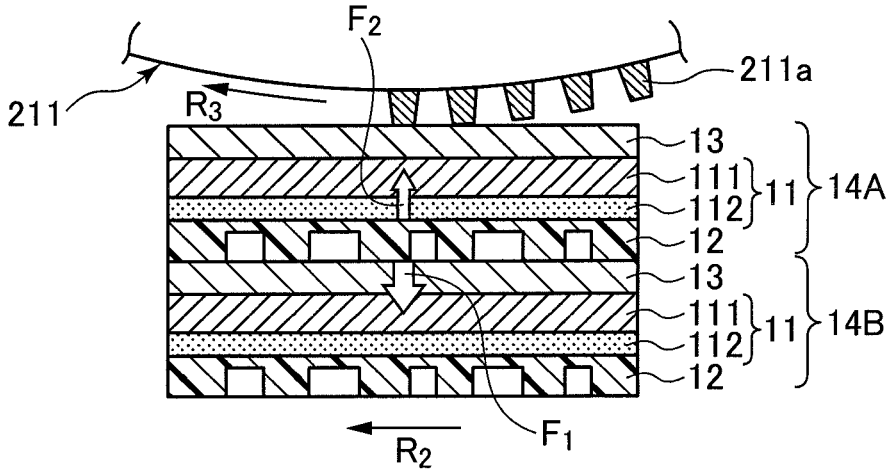
FIG. 13A is a cross-sectional view schematically illustrating a state where an ink layer of the outer ink ribbon is made to adhere to the back surface layer of the inner ink ribbon with adhesive strength higher than strength of adhesion to a primer layer in an operation example of the heat transfer system according to the second embodiment.
Figure 13B:
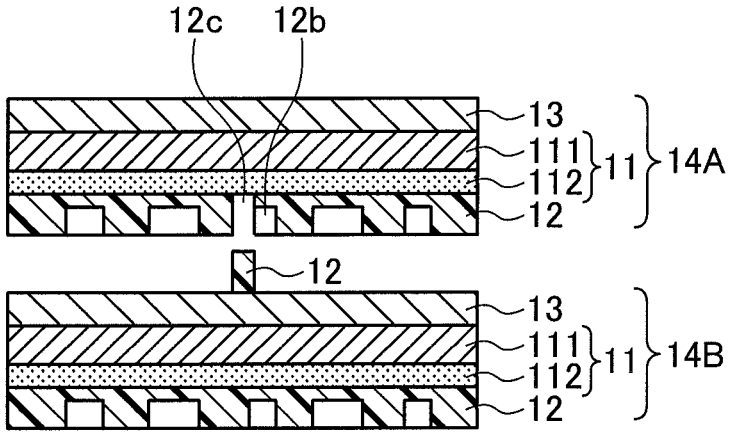
FIG. 13B is a cross-sectional view schematically illustrating a state of ink transfer in the second pattern to the back surface layer of the inner ink ribbon.

FIG. 13A is a cross-sectional view schematically illustrating a state where the ink layer 12 of the outer ink ribbon 14A is made to adhere to the back surface layer 13 of the inner ink ribbon 14B with adhesive strength higher than strength of adhesion to the primer layer 112 in an operation example of the heat transfer system 10 according to the second embodiment. FIG. 13B is a cross-sectional view schematically illustrating a state of ink transfer in the second pattern to the back surface layer 13 of the inner ink ribbon 14B.

As described above, because a molar equivalent ratio (—NCO/—OH) is 0.5 or less in the second embodiment, the curing degree of the back surface layer 13 is suppressed. Because the curing degree is suppressed, adhesive strength $F_1$ between the back surface layer 13 of the inner ink ribbon 14B and the ink layer 12 of the outer ink ribbon 14A is higher than adhesive strength $F_2$ between the ink layer 12 of the outer ink ribbon 14A and the primer layer 112 of the outer ink ribbon 14A, as illustrated in FIG. 13A. Therefore, it is possible to surely transfer the ink layer 12 of the outer ink ribbon 14A to the back surface layer 13 of the inner ink ribbon 14B, as illustrated in FIG. 13B. Transfer of the ink layer 12 from the outer ink ribbon 14A to the back surface layer 13 of the inner ink ribbon 14B can occur when the second heating element 21 is made to generate heat, or when the inner ink ribbon 14B and the outer ink ribbon 14A are separated from each other after the second heating element 21 generates heat.

Further, as another embodiment, the primer layer 112 can be configured in such a manner that the adhesive strength $F_1$ between the back surface layer 13 of the inner ink ribbon 14B and the ink layer 12 of the outer ink ribbon 14A is higher than adhesive strength $F_3$ between the resin layer 111 of the outer ink ribbon 14A and the primer layer 112 of the outer ink ribbon 14A. In this case, the same advantageous effects can be obtained by transferring the ink layer 12 and the primer layer 112 of the outer ink ribbon 14A to the back surface layer 13 of the inner ink ribbon 14B.

Furthermore, also in the second embodiment, similarly to the first embodiment, the controller 24 causes the first heating element 22 to generate heat at a temperature at which abnormal transfer of the ink layer 12 is suppressed and causes the second heating element 211 to generate heat at a temperature at which abnormal transfer of the ink layer 12 is caused to occur. In a case of using the ink ribbon 14 according to the second embodiment, it is preferable that the controller 24 causes the second heating element 211 to generate heat at a temperature of 180° C. or more and 220° C. or less.

As described above, according to the second embodiment, use of the back surface layer 13 of which the curing degree is suppressed can make adhesive strength between the back surface layer 13 of the inner ink ribbon 14B and the ink layer 12 of the outer ink ribbon 14A higher than adhesive strength between the ink layer 12 of the outer ink ribbon 14A and the primer layer 112 of the outer ink ribbon 14A. Therefore, the ink layer 12 of the outer ink ribbon 14A can be surely thermal-transferred to the back surface layer 13 of the inner ink ribbon 14B. Accordingly, it is possible to prevent printed personal information from being identified from the ink omission part 12*b* in the first pattern.

In the second embodiment, the controller 24 can control the second heating element 211 to cause the outer ink ribbon 14A to be fused and adhere to the inner ink ribbon 14B in a portion of the second pattern. For example, the controller 24 can cause the second heating element 211 to generate heat at a temperature at which abnormal transfer of the ink layer 12 of the outer ink ribbon 14A occurs in transfer at a certain point or in a certain section in the second pattern, and can cause the second heating element 211 to generate heat at a higher temperature than the temperature at which abnormal transfer of the ink layer 12 occurs in transfer at another point or in another section in the second pattern. By causing the second heating element 211 to generate heat at the higher temperature than the temperature at which abnormal transfer of the ink layer 12 occurs, resins in the ink ribbons 14A and 14B can be melted, so that the both ink ribbons 14A and 14B are fused to adhere to each other. Similarly, the amount of heat applied to the ink ribbon 14A with the second heating element 211 can be increased by partially slowing down a winding speed, so that the ink ribbon 14A is partially fused to adhere to the inner ink ribbon 14B. Alternatively, the amount of heat applied to the ink ribbon 14A with the second heating element 211 can be increased by partially increasing a pressure applied by the second heating element 211, so that the ink ribbon 14A is partially fused to adhere to the inner ink ribbon 14B.

By bonding the inner ink ribbon 14B and the outer ink ribbon 14A to each other, the both ink ribbons 14A and 14B can easily tear when the both ink ribbons 14A and 14B are to be separated from each other. Therefore, it is possible to prevent printed personal information from being identified from the ink omission part 12*b* in the first pattern more surely.

In addition, the first embodiment and the second embodiment can be combined with each other in an appropriate manner. For example, the back surface layer 13 of the ink ribbon 14 according to the second embodiment can be configured to contain phosphate ester described in the first embodiment. Further, the heat transfer system 10 according to the second embodiment and the first to fourth modifications of the first embodiment can be combined to one another as appropriate.

Although several embodiments of the present disclosure have been described above, these embodiments are presented for purposes of illustration only and are not intended to limit the scope of the disclosure. These embodiments can be also carried out in other various modes, and various types of omissions, replacements, and modifications can be made without departing from the spirit of the invention. These embodiments and modifications thereof are included in the spirit and scope of the present disclosure, and are also included in the disclosure described in the appended claims and equivalents thereof.

The invention claimed is:

1. A heat transfer system that transfers ink to a transfer-receiving body by using an ink ribbon including a base layer, an ink layer being on one surface of the base layer and containing a thermal migratory dye, and a back surface layer on the other surface of the base layer, the heat transfer system comprising:

a sending part sending the ink ribbon;

a first heating element heating the ink ribbon from the back surface layer side on a downstream side of the sending part so as to transfer ink in the ink layer to the transfer-receiving body in a first pattern;

a winding part winding the ink ribbon having ink transferred therein on a downstream side of the first heating element in such a manner that the back surface layer is positioned outside the ink layer;

a second heating element near the winding part, configured to heat the ink ribbon after the ink is transferred from the back surface layer side to transfer ink in the ink layer to the back surface layer inside the ink layer in a second pattern that is different from the first pattern; and a controller controlling the first heating element and the second heating element, wherein the controller controls the first heating element to transfer ink corresponding to the first pattern by transferring a portion of the ink layer, and controls the second heating element so that heat is generated at a temperature at which ink corresponding to the second pattern is transferred with the ink layer as a whole, the back surface layer contains phosphate ester, the base layer includes a primer layer that is in contact with the ink layer, the primer layer contains inorganic fine particles enhancing adhesiveness of the ink layer to the base layer, the controller controls the second heat element to cause migration of the phosphate ester from a back surface layer of an inner ink ribbon to a primer layer of an outer ink ribbon, the migration of the phosphate ester causes the ink of the second pattern in the ink layer of the outer ink ribbon to be transferred to the back surface layer of the inner ink ribbon with the ink layer as a whole, adhesiveness of the ink of the second pattern to the base layer of the outer ink ribbon being enhanced by the inorganic fine particles, and an ink omission part in the second pattern is formed in the ink layer of the outer ink ribbon to disturb an ink omission part in the first pattern by the transfer of the ink of the second pattern.

2. The heat transfer system of claim 1, wherein the back surface layer contains a resin cured by an isocyanate-series curing agent, and an isocyanate-series curing agent that has not yet reacted with the resin.

3. The heat transfer system of claim 2, wherein the resin contains a polyvinyl acetal-series resin.

4. The heat transfer system of claim 1, wherein the back surface layer contains an acrylic resin and a silicone resin, and the silicone resin contains at least either an amino-modified silicone resin or a carboxy-modified silicone resin.

5. The heat transfer system of claim 1, wherein the inorganic fine particles are alumina sol or colloidal silica.

6. The heat transfer system of claim 5, wherein the primer layer contains a water-based resin.

7. The heat transfer system of claim 1, further comprising a gear-shaped member pressing the ink ribbon having ink transferred therein between the first heating element and the winding part.

8. The heat transfer system of claim 1, wherein the winding part includes a cushion layer on its outer circumferential surface.

9. The heat transfer system of claim 1, wherein the ink ribbon includes a cushion part in its starting portion.

10. A winding device that winds therearound an ink ribbon including a base layer, an ink layer on one surface of the base layer, and a back surface layer on the other surface of the base layer after ink in the ink layer is transferred to a transfer-receiving body in a first pattern, the winding device comprising:

a winding part winding the ink ribbon having ink transferred therein therearound in such a manner that the back surface layer is positioned outside the ink layer;

a heating element heating the ink ribbon having ink transferred therein from the back surface layer side near the winding part to transfer ink in the ink layer to the back surface layer inside the ink layer in a second pattern that is different from the first pattern; and a controller controlling the heating element, wherein the controller controls the heating element so that heat is generated at a temperature at which ink corresponding to the second pattern is transferred with the ink layer as a whole, the back surface layer contains phosphate ester, the base layer includes a primer layer that is in contact with the ink layer, the primer layer contains inorganic fine particles enhancing adhesiveness of the ink layer to the base layer, the controller controls the heat element to cause migration of the phosphate ester from a back surface layer of an inner ink ribbon to a primer layer of an outer ink ribbon, the migration of the phosphate ester causes the ink of the second pattern in the ink layer of the outer ink ribbon to be transferred to the back surface layer of the inner ink ribbon with the ink layer as a whole, adhesiveness of the ink of the second pattern to the base layer of the outer ink ribbon being enhanced by the inorganic fine particles, and an ink omission part in the second pattern is formed in the layer of the outer ink ribbon to disturb an ink omission part in the first pattern by the transfer of the ink of the second pattern.

11. A heat transfer method of transferring ink to a transfer-receiving body by using an ink ribbon including a base layer, an ink layer on one surface of the base layer, and a back surface layer on the other surface of the base layer, the heat transfer method comprising:

sending the ink ribbon;

heating the sent ink ribbon with a first heating element from the back surface layer side to transfer ink in the ink layer to the transfer-receiving body in a first pattern;

winding the ink ribbon having ink transferred therein in such a manner that the back surface layer is positioned outside the ink layer; and heating the wound ink ribbon having ink transferred therein with a second heating element from the back surface layer side to transfer ink in the ink layer to the back surface layer inside the ink layer in a second pattern that is different from the first pattern, wherein transferring in the first pattern is performed by transferring ink corresponding to the first pattern by transferring a portion of the ink layer, and transferring in the second pattern is performed by controlling the second heating element so that heat is generated at a temperature at which ink corresponding to the second pattern is transferred with the ink layer as a whole, the back surface layer contains phosphate ester, the base layer includes a primer layer that is in contact with the ink layer, the primer layer contains inorganic fine particles enhancing adhesiveness of the ink layer to the base layer, heating with the second heating element causes migration of the phosphate ester from a back surface layer of an inner ink ribbon to a primer layer of an outer ink ribbon, the migration of the phosphate ester causes the ink of the second pattern in the ink layer of the outer ink ribbon to be transferred to the back surface layer of the inner ink ribbon with the ink layer as a whole, adhesiveness of the ink of the second pattern to the base layer of the outer ink ribbon being enhanced by the inorganic fine particles, and an ink omission part in the second pattern is formed in the layer of the outer ink ribbon to disturb an ink omission part in the first pattern by the transfer of the ink of the second pattern.

* * * * *